United States Patent [19]

Englin

[11] Patent Number: 4,614,213

[45] Date of Patent: Sep. 30, 1986

[54] BAG FILLER APPARATUS

[75] Inventor: Robert A. Englin, Waverly, Minn.

[73] Assignee: St. Peter Creamery, St. Peter, Minn.

[21] Appl. No.: 616,391

[22] Filed: Jun. 1, 1984

[51] Int. Cl.[4] ..... B65B 1/28

[52] U.S. Cl. ..... 141/59; 141/114; 141/314; 141/65; 141/83

[58] Field of Search ..... 141/10, 59–68, 141/114, 383, 313–317, 72, 83, 392, 105–107, 85, 93, 250–262; 53/403, 408, 510

[56] References Cited

U.S. PATENT DOCUMENTS

| | | | |
|---|---|---|---|
| 1,189,748 | 7/1916 | Southard | 141/317 |
| 2,671,585 | 3/1954 | Kindseth | 141/314 |
| 2,839,093 | 6/1958 | McCarthy | 141/59 X |
| 2,853,105 | 9/1958 | Brown | 141/285 |
| 2,985,201 | 5/1961 | Baker | 141/12 |
| 3,149,649 | 9/1964 | Hix | 141/93 |
| 3,498,344 | 3/1970 | Schwake et al. | 141/317 |
| 3,502,119 | 3/1970 | Sweeney | 141/314 |
| 4,182,591 | 1/1980 | Stanelle | 141/93 X |
| 4,212,331 | 7/1980 | Benatar | 141/67 |
| 4,344,468 | 8/1982 | Sandberg | 141/314 |
| 4,387,749 | 6/1983 | Donisi | 141/68 |
| 4,391,310 | 7/1983 | Lepisto | 141/286 |

OTHER PUBLICATIONS

Brochure, "Dust Free Bagging Machine", by Zeelan, Inc.

Brochure, "Sanitary Filling Scales", by Thayer Scale.

Brochure, "Dust-Free Powder Packing . . . ", by Nu-Con Systems Ltd.

Brochure, "Nu-Con News", by Nu-Con Systems Ltd.

*Primary Examiner*—Stephen Marcus

*Assistant Examiner*—Ernest G. Cusick

*Attorney, Agent, or Firm*—Merchant, Gould, Smith, Edell, Welter & Schmidt

[57] ABSTRACT

The present invention relates to a bag filler apparatus (20) for filling bags (105) with a powdered product, the bags (105) commonly having side walls interconnecting an open top portion and a closed bottom portion. The bag filler apparatus (20) includes a support framework (78) supporting a surge hopper (28) and a scale hopper (60) interconnected so as to provide a path for the flow of the powdered product from the surge hopper (28) to the scale hopper (60). A feed auger (30) is provided for conveying the powdered product to the surge hopper (28) while a butterfly valve (66) controls the flow of the powdered product into the scale hopper (60) from the surge hopper (28). The scale hopper (60) is provided with weight sensitive elements (76) for sensing the weight of the powdered product in the scale hopper (60). A butterfly valve (86) and a fill chute (98) provide for discharge of the powdered product from the scale hopper (60). A fill chute adaptor (104) circumferentially surrounds the fill chute (98) so as to define an annular space (106) wherein a partial vacuum condition is created during the bag filling process such that the bag filling operation is essentially dust free. In addition, the partial vacuum condition in the annular space (106) retains the bag (105) on the fill chute adaptor (104) when empty and facilitates retention during the actual filling process.

8 Claims, 13 Drawing Figures

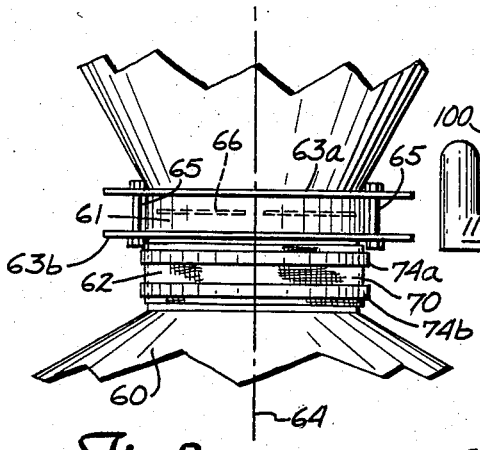
Fig. 3
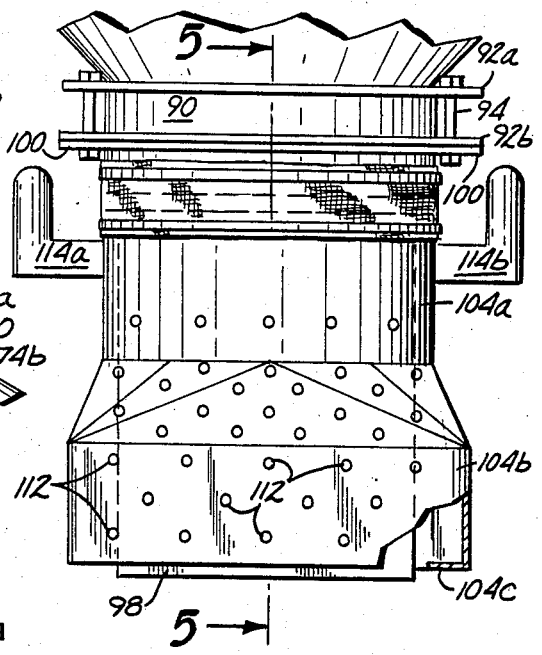
Fig. 4
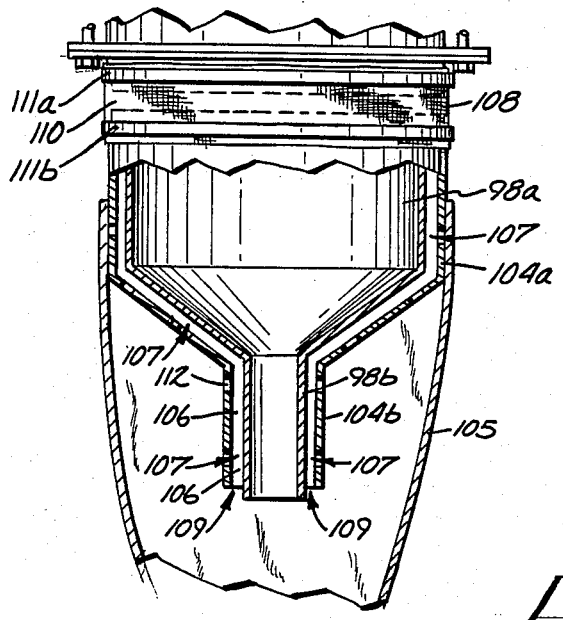
Fig. 5
Fig. 6
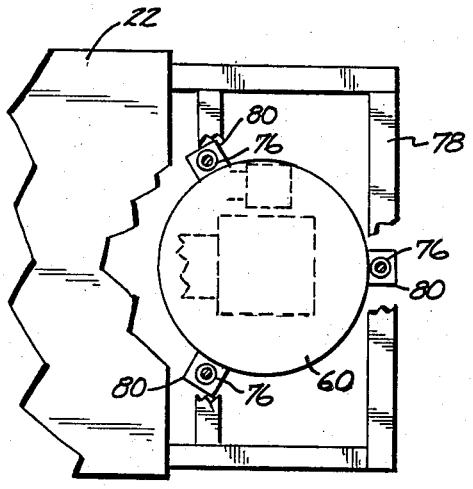

| | |
|---|---|
| HOA | HAND - OFF - AUTO |
| CR | CONTROL RELAY |
| MS | MOTOR STARTER |
| TR | TIMER RELAY |
| V B1 V B2 | VIBRATOR SOLENOID VALVE |
| —\|\|— | NORMALLY OPEN CONTACT |
| —\|/\|— | NORMALLY CLOSED CONTACT |
| HL-1, HL-2A, LL-1 AND HL-2B | LEVEL SENSORS |
| ZS-3-B | LIMIT SWITCHES (MICRO) |
| —☼— | INDICATOR LIGHT |
| F T | FILTER TIMER CLEANS DUST COLLECTOR |
| OL | OVERLOAD FOR MOTOR STARTER |

BAG FILLER APPARATUS

BACKGROUND OF THE INVENTION

The present invention relates to a bag filler apparatus for use in conjunction with bags or other flexible containers adapted to contain a granular or powdered product. More particularly, the present invention relates to a bag filler apparatus including a fill chute adapter providing for essentially dust free operation.

While there are several bag filler apparatus which have been developed as is evidenced by U.S. Pat. Nos. 4,391,310 to Lepisto and 4,387,749 to Donisi, there are two major problems with existing bag filler apparatus which are used with granular or powdered products, particularly in the food industry. The first of these problems is one of cleanliness. When bagging such products as powdered dairy foods, a large amount of dust or granular particulate is emitted into the ambient air, which creates a health problem for both the workers who breath in the air and the granular food product which is being bagged. Oftentimes, the dust is so bad that workers are required to wear filter masks in an effort to filter out the particulate. In addition, a fine layer of dust collects on any exposed surfaces of the machinery or the building wherein the apparatus is contained. This layer of dust is very conducive to the growth of bacteria or the like which can cause contamination of the food product being bagged.

Some filler apparatus have attempted to solve this problem by the creation of a suction force proximate the discharge point into the bag. However, in addition to other differences and problems the suction force is constantly present so that room air is being drawn. Also, the suction is not utilized to hold the bag at the discharge point thereby freeing the operator for other tasks during the fill operation. Further, most of these devices are not efficient in providing dust free operation.

Another major concern or problem is yield. Many bag filler apparatus are not very accurate. While to the consumer this might not appear to be significant, nevertheless to the food producer who bags thousands of pounds of food product a day, this inaccuracy can reduce the profitability and yield of the operation. In addition, the dust which escapes during the filling process can after an extended period of time also impact the overall efficiency of the operation.

Also related to the problem of yield is that the bag fill rate of many bag filler apparatus is slow thereby severely limiting the overall output per given period of time.

Additionally, many bag filler apparatus are not easy to operate requiring a skilled operator and careful attention to the actual operations.

Yet another problem with many existing filler apparatus is that they do not provide a totally self-contained system, thereby requiring that various elements or parts of the filler apparatus be spread throughout the building, thereby further complicating matters and requiring substantial space which is another drawback with any filler apparatus.

The present invention solves these and many other problems associated with currently available bag filler apparatus.

SUMMARY OF THE INVENTION

The present invention relates to a bag filler apparatus for filling bags with a powdered product, the bags commonly having side walls interconnecting an open top portion and a closed bottom portion. The apparatus includes a support framework supporting a surge hopper means for holding a first quantity of the powdered product. First conveyor means is provided for conveying the powdered product to the surge hopper means. Scale hopper means is provided for holding a second quantity of the powdered product. The scale hopper means is interconnected to the surge hopper means by interconnection means providing a path for the flow of the powdered product from the surge hopper means to the scale hopper means. First valve means cooperates with the interconnection means for controlling the flow of the powdered product into the scale hopper means from the surge hopper means. Fill chute means interconnected proximate the bottom of the scale hopper means provides a path for the flow of the powdered product from the surge hopper means. Second valve means cooperates with the fill chute means for controlling the flow of the powdered product from the scale hopper means. Fill chute adaptor means adapted for insertion into the open top portion of a bag cooperates with the fill chute means so as to define an air space between the fill chute means and the fill chute adaptor means, the fill chute adaptor means having side walls with a plurality of apertures therein and being at least partially open at a lower end thereof. Vacuum means interconnected to the fill chute adapter means creates a partial vacuum condition in the air space between the fill chute means and the fill chute adapter means whereby the side walls of the bag proximate the open top portion thereof are drawn inwardly against the fill chute adapter means and particulate suspended into the bag is removed therefrom. Control means is provided for controlling the operation of the first and second valve means and the vacuum means. The control means includes weight sensing means for sensing the weight of the powdered product in the scale hopper means. The control means includes means for terminating the partial vacuum condition when the bag is removed from the fill chute adapter means, whereby room air outside of the bag is not drawn into the vacuum means when the bag is removed.

One particularly advantageous feature of the present invention is its essentially dust free operation. In one embodiment of the present invention, a fill chute adapter is coaxially positioned about the end of a fill chute so as to provide an air space therebetween. The air space is in communication with a vacuum apparatus which creates a partial vacuum or negative pressure between the fill chute adapter and the fill chute. As a result, granular or powdered product which might otherwise escape into the surrounding air is removed to a dust filter apparatus. In addition, the fill chute adapter includes a plurality of apertures therein so as to provide inward suction force on the bag so as to retain the bag on the fill chute adapter.

Yet another particularly advantageous feature of the present invention is its accuracy. In one embodiment of the present invention, two differing sizes of augers are utilized, the larger of which serves as a feed auger for providing rapid feeding of the powdered product while the smaller of the augers serves as a metering auger providing for accurate metering of the powdered product.

In the preferred embodiment, the feed and metering augers are horizontally configured thereby further facilitating control and accuracy. In addition, the feed auger has four flights and metering auger is double flighted to prevent the powdered product, which frequently has the consistency or viscosity of water, from flowing along the augers when the augers are shut off. In addition, the outside diameter of the flighting is only slightly less than the inside diameter of the trough in which mounted.

In the preferred embodiment, the scale hopper wherein the powdered product is weighed is interconnected by a flexible connection to the source of the powdered product and is pivotally suspended from a stationary frame by three evenly spaced load cells positioned circumferentially about the circumference of the scale hopper. Accordingly, greater weighing accuracy is provided than utilizing only a single load cell and/or a rigid interconnection.

In the preferred embodiment, varying sizes of fill chute adaptors are provided for varying sizes of bags.

Yet another advantageous feature of the preferred embodiment of the present invention is the provision of a surge hopper which includes adjustable level detectors to facilitate use with varying quantities and densities of powdered product. The present invention is readily adaptable to many different operating environments including varying bag sizes and rates of operation.

Yet another advantageous feature of the present invention is its relatively fast operation, one embodiment of the present invention having a rate of three to ten bags per minute.

Still another advantageous feature of the present invention is its ease of use. The operator need pay little attention to the actual operation and one person can operate the actual bag filling process.

Still another advantageous feature of the present invention is that it provides for a self-contained totally integrated system, thereby doing away with the requirement for additional parts to be purchased later and installed separately.

Another advantageous feature of the present invention is its minimal space requirement. One embodiment of the present invention has a foot print of approximately 6½ square feet.

Yet another advantageous feature of the present invention is the incorporation of a dust filter assembly for collecting the dust which is removed during the bagging process. In the preferred embodiment of the present invention, the collected dust or powdered product will be a product fit for human consumption.

Yet another advantageous feature of the present invention is its ease of cleaning, the various parts being readily accessible for cleaning purposes, many of the parts being made from stainless steel.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

FIG. 3 is an enlarged partial elevational view of the flexible connection between the surge hopper and scale hopper of the embodiment shown in FIG. 1;

FIG. 4 is an enlarged front end elevational view of the fill chute adapter of the embodiment shown in FIG. 1;

FIG. 5 is a sectional view as seen generally along the line 5—5 in FIG. 4;

FIG. 6 is a top plan diagrammatic view showing positioning of the load cells of the embodiment illustrated in FIG. 1;

DETAILED DESCRIPTION OF THE PREFERRED EMBODIMENT

Figure 1:
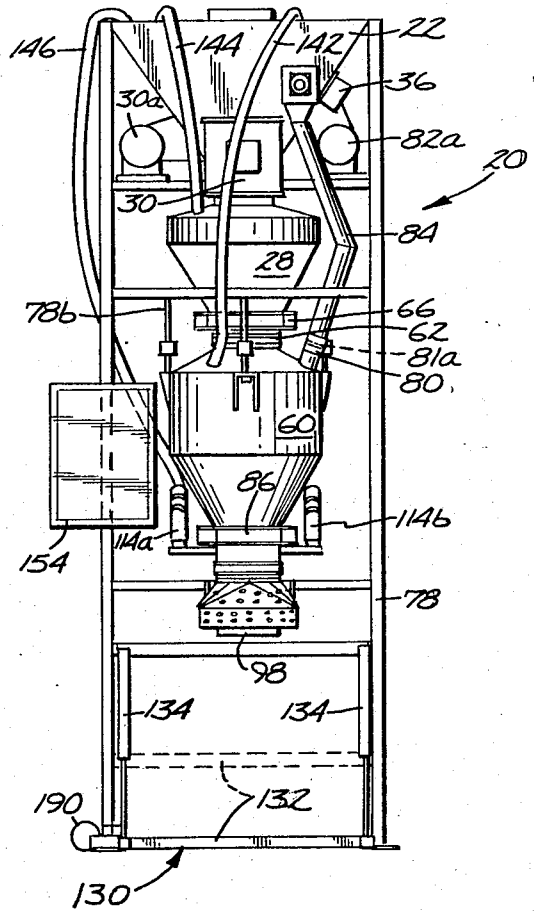
FIG. 1 is a front end elevational view of a preferred embodiment of a filler apparatus embodying the principles of the present invention.
Figure 2:
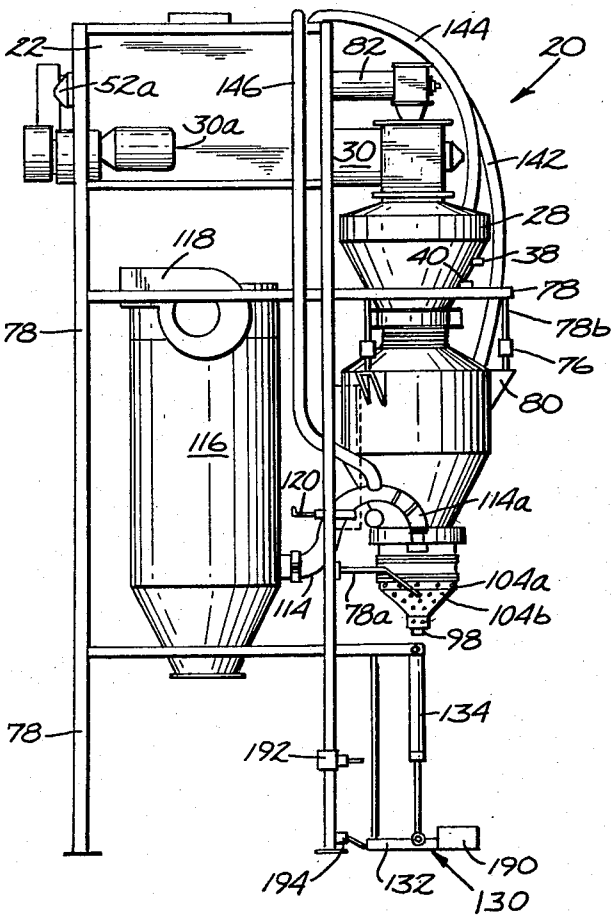
FIG. 2 is a side elevational view of the embodiment shown in FIG. 1.
Figure 7:
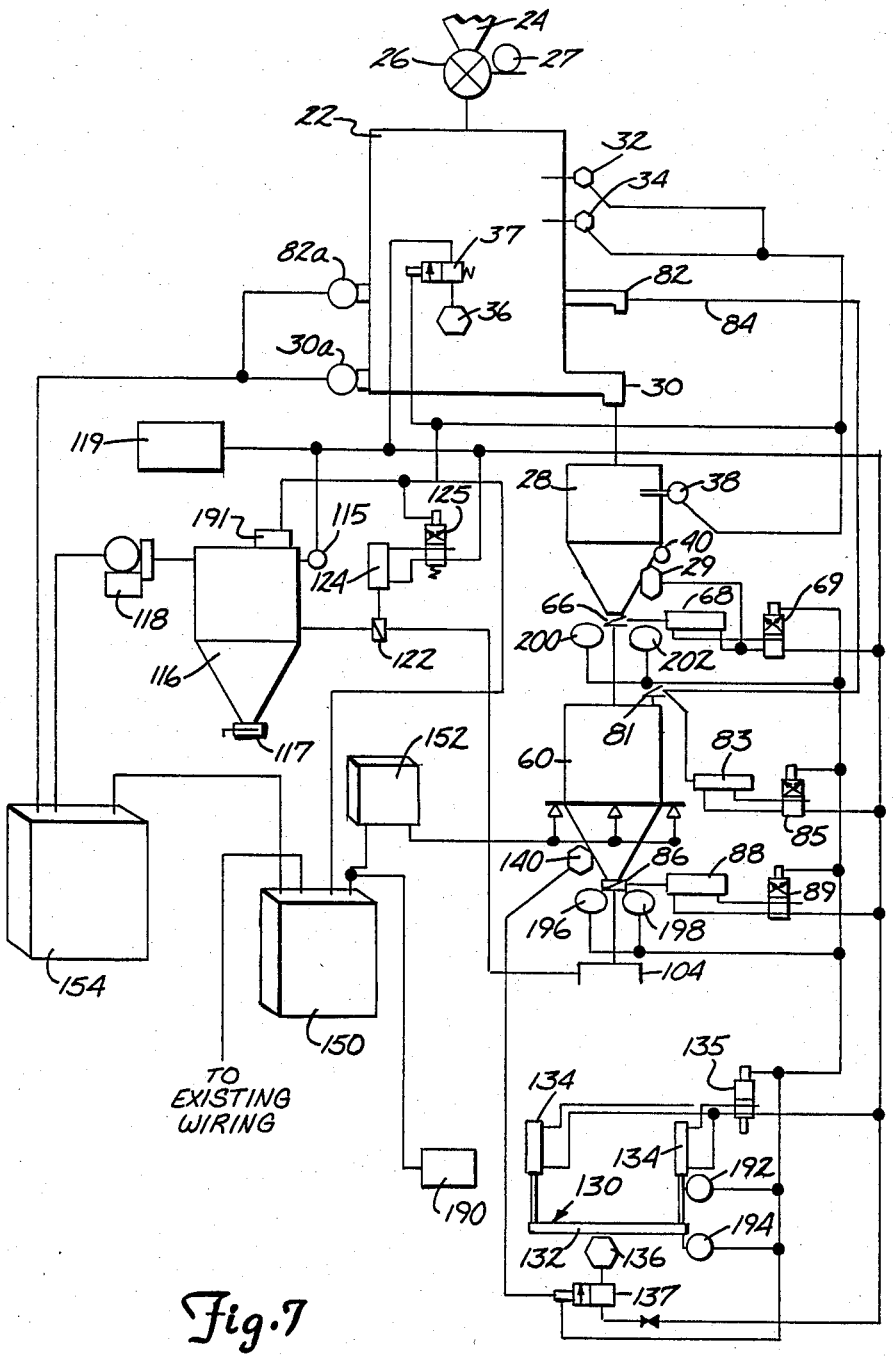
FIG. 7 is an overall system schematic of the bag filler apparatus shown in FIG. 1.

Illustrated in FIGS. 1 and 2 is a preferred embodiment of a filler apparatus, generally designated by the reference numeral 20, embodying the principles of the present invention. The filler apparatus includes a feed hopper 22 which is interconnected to an existing storage tank or newly installed storage tank, generally being designated by the reference numeral 24 in FIG. 7, via an air lock 26 or the like, the air lock 26 being powered by a suitable electrical motor 27. The feed hopper 22 is interconnected to the top of a surge hopper 28 by a horizontally disposed, quadruple flighted nine inch feed auger or screw conveyor 30 which is gear driven by its corresponding electrical motor 30*a*. The feed hopper 22, in the preferred embodiment illustrated, includes a high level detector 32 on the inside thereof for closing the feeder air lock 26 when the powdered or granular product reaches a predetermined high level mark. In addition, the feed hopper 22 includes a low level detector 34 for activating the feeder air lock 26 when the powdered or granular product falls below a predetermined low level in the feed hopper 22. As illustrated in the system schematic of FIG. 7, the preferred embodiment also includes a vibrator 36 and its associated solenoid 37 for periodically or on command vibrating the feed hopper 22. The surge hopper 28 includes an adjustable high level detector 38 for shutting off the feed auger 30 when the powdered or granular product reaches a predetermined high level in the surge hopper 28. The height or vertical positioning of the detector 38 is adjustable so that the bag filler apparatus can be utilized with a wide range of bag size and/or product densities. The level detector 38 might be mounted by any number of known methods for such adjustment capability. As illustrated in FIG. 7, the surge hopper 28 might also include a second adjustable high level detector 40. Two of these indicators might be provided so that one or the other of the high level detectors 38, 40 can be readily selected by the operator to enable rapid switching between two different bag sizes; for example fifty pounds or one hundred pounds and/or two different powered products of different density.

The surge hopper 28 is flexibly interconnected to a scale hopper 60 by a flexible interconnection 62 coaxially positioned about a longitudinal axis 64 of the surge and scale hoppers 28, 60, the surge and scale hoppers being longitudinally aligned end for end. In addition, a ten inch butterfly valve 66, operated by an air cylinder 68 and its associated solenoid 69, is positioned between the flexible interconnection 62 and the surge hopper 28 so as to provide control over the delivery of the powdered or granular product from the surge hopper 28 into the scale hopper 60. As illustrated in FIG. 3, the butterfly valve 66 includes a housing 61 which is suitably fastened to the end of the surge hopper 28 by a retaining ring 63*a, b* and fastener 65 arrangement. The surge hopper 28 will preferably include a vibrator 29 which is activated when the powdered product is being delivered from the surge hopper 28 so that an electrical short is not created by powdered product building up on the probes of the detectors 38, 40 on the inside of the surge hopper 28. Illustrated in FIG. 3 is an enlarged partial view of the flexible interconnection 62. As illustrated, in the preferred embodiment the flexible interconnection 62 includes a flexible piece of material 70, such as DACRON (registered trademark) felt which is interconnected to the butterfly valve 66 by a draw band 74*a*, a similar draw band 74*b* interconnecting the flexible material 70 to the scale hopper 60.

The feed hopper 22, surge hopper 28, and scale hopper 60 are supported by a support framework assembly 78. The scale hopper 60 and the surge hopper 28 are supported independently of each other. The scale hopper 60 is suspended from the framework assembly 78 by three elongated frame members 78*b* interconnected to the scale hopper 60 by suitable brackets 80 positioned at evenly spaced locations about the circumference of the scale hopper 60. Positioned intermediate of the ends of the frame members 78*b* are weight sensing elements 76. In the preferred embodiment load cells sold under the trademark DYNE-CELL, series AB 200 lb., are utilized. The load cells 76 are pitovally interconnected proximate their top and bottom to the elongated members 78*b*. The scale hopper 60 is therefore independently supported and capable of pivotal motion about its longitudinal axis whereby accurate weight readings can be obtained.

In addition, the feed hopper 22 is interconnected by a horizontally extending, double flighted four inch metering auger or screw conveyor 82 to the scale hopper 60 which is gear driven by its associated motor 82*a*. The metering auger 82 as well as the feed auger 30 can be readily disassembled to facilitate cleaning. The metering auger 82 is interconnected to the scale hopper 60 by a generally vertically extending chute 84. As illustrated in FIGS. 1, 2, and 7, a butterfly valve 81 is positioned proximate the bottom of the chute 84 and will include an associated air cylinder 83 and solenoid 85. The butterfly valve 81 will close when the four inch metering auger 82 is shut off to prevent powdered product which is in the chute 84 from falling into the scale hopper 60. The chute 84 is interconnected to the scale hopper 60 by a flexible portion 81*a* so as to not interfere with the weight or movement of the scale hopper 60. The metering auger 82 might be at the same vertical height as the feed auger 30 or at a different height as illustrated in FIGS. 1–2.

Positioned coaxially at the bottom of the scale hopper 60 is a butterfly valve 86 which is operated by an air cylinder 88 and its associated solenoid 89. As illustrated in FIGS. 4 and 5, the butterfly valve 86 includes a housing 90 which is suitably fastened to the end of the scale hopper 60 by a retaining ring 92*a, b* and fastener 94 arrangement. Suitably attached to the retaining ring member 92*b* by the fasteners 94 is an axially extending fill chute 98. The fill chute 98 has a cylindrical upper portion 98*a* and a rectangular lower portion 98*b*. In the preferred embodiment, the fill chute 98 includes a collar or ring member 100 which is suitably fastened to the ring member 92*b*. As further illustrated in FIGS. 4 and 5, coaxially positioned about the fill chute 98 and radially spaced therefrom is a fill chute adaptor member 104 which is generally cylindrical at a top portion 104*a* and generally rectangular at a bottom portion 104*b*. In the preferred embodiment, the fill chute adaptor member 104 is interconnected to the scale hopper 60 by a flexible connection 108. The flexible connection 108 includes a flexible material 110, such as DACRON (registered trademark), felt or nylon which is interconnected to the scale hopper 60 by a drawband 111*a* to the adaptor member 104 by a drawband 111*b*. The adaptor member 104 is supported independently of the scale hopper 60 by members 78*a* of the frame assembly 78 so that movement of the fill chute adaptor member 104 will not interfere with the weight sensitive elements 76.

The rectangular portion 104*b* facilitates insertion of a bag over the fill chute adaptor 104 while the top portion 104*a* conforms to the configuration of the scale hopper 60 and facilitates opening of the bag into which powder is delivered. The fill chute adapter 104 will preferably come in differing sizes for use with different sizes of bags. As illustrated in FIG. 4, different sized fill chute adaptors might include a horizontal, inwardly extending flange 104*c* in order to maintain the opening at the bottom of the fill chute adapter 104 at a constant size so that the suction force will not be affected by using different sized adaptors. An annular space 106 separates the fill chute 98 from the fill chute adaptor 104 which has a plurality of apertures 112 therein.

Interconnected to opposite sides of the cylindrical portion 104*a* of the fill chute adaptor 104 are two vent hoses 114*a, b*. The vent hoses 114*a, b* later merge into a single hose 114 and are interconnected to a dust filter apparatus 116 which includes a normally continuously operating fan 118 which in cooperation with a compressor 119 providing compressed air at 92 to 125 pounds per square inch of gas, creates a partial vacuum in the dust filter apparatus 116 and correspondingly in the vent hoses 114*a, b* and in the annular space 106 between the fill chute 98 and the fill chute adaptor 104. The vent hoses 114*a, b* are interconnected to the fill chute adaptor 104 on opposite sides thereof to provide a more uniform suction force. The vent hose 114 includes a manual slide gate 120 therealong intermediate the fill chute adaptor 104 and the filter apparatus 116 for manually adjusting the amount of vacuum at the fill chute adaptor 104. Also interconnected to the vent hose 114 line is a butterfly valve 122 which is operated by an air cylinder 124 and its associated solenoid 125 for closing and opening the vent hose 114 as necessary to create a partial vacuum condition in the air space 106.

The partial vacuum condition in the air space 106 is selectively activated under operator control by causing the butterfly valve 122 to open only when a bag 105 is inserted over the fill chute adaptor 104. As indicated by the arrows 107 and 109 in FIG. 5, when the partial vacuum condition is created in the air space 106 there is a resulting suction force which will pull inwardly on the sides of the bag 105 inserted over the fill chute adaptor 104 so as to retain the bag 105 on the fill chute adaptor when empty and remove any suspended dust or particulate suspended on the inside of the bag 105 during the fill process. Further the suction force will retain the bag 105 in tight contact with the adaptor member 104 during the fill process so that no dust or particulate escapes into the room.

The dust filter apparatus 116 may be a conventional bag house with filter socks such as commonly known by the registered trademark DUSTEX. the dust filter apparatus might include a timer/vibrator arrangement 115 for periodically vibrating the dust filter apparatus 116 to clean the filter socks. Since the suction at the fill chute adaptor 104 occurs only during the bag fill process the suction force being shut off preferably when the bag is lowered below the top row of the apertures 112 in the fill chute adaptor 104, the powdered or granular product collected in the dust filter apparatus 116 is fit for human consumption. The product is removed from the dust filter apparatus 116 by use of a manually operated gate 117. Furthermore, the dust filter apparatus 116 applies suction at the fill chute adaptor 104 only during the fill process and assists in holding the bag in place.

Positioned below the fill chute adaptor 104 is a carriage assembly 130 including a platform 132 which is vertically raised and lowered by a pair of air cylinders 134 and their associated solenoid 135. Operatively interconnected to the carriage assembly 130 is a vibrator 136 operated by its associated solenoid 137 for vibrating the platform 132. Also electrically operated by the solenoid 137 is a vibrator 140 for vibrating the scale hopper 60. The carriage assembly 130 provides support for the bag 105 during the fill process.

The surge hopper 28 and the scale hopper 60 are interconnected to the feed hopper 22 by hollow conduits 142, 144 respectively, which serve as positive pressure lines for venting the scale hopper 60 and the surge hopper 28 into the feed hopper 22 when powdered product is delivered thereto. A negative pressure line 146 is positioned between the feed hopper 22 and the vent hose 114 so as to create a suction in the feed hopper 22 and thereby remove any dust in the feed hopper 22.

The bag filler apparatus of the present invention includes a control panel 150 providing for operator control of the filler apparatus. Also included is a scale panel 152 which is utilized to select the weight of the product desired in the scale hopper 60 and is operatively interconnected to the load cells 76 to monitor the scale hopper 60 and shut off the feed auger 82 when the desired weight is reached. The control panel 150 and scale panel operate on 120 volt A.C. current. A power panel 154 has a 120 volt AC transformer for providing three phase power at 60 hertz, 460 volts to the elements of the system, such as the various motors, requiring such electrical input.

Figure 8:
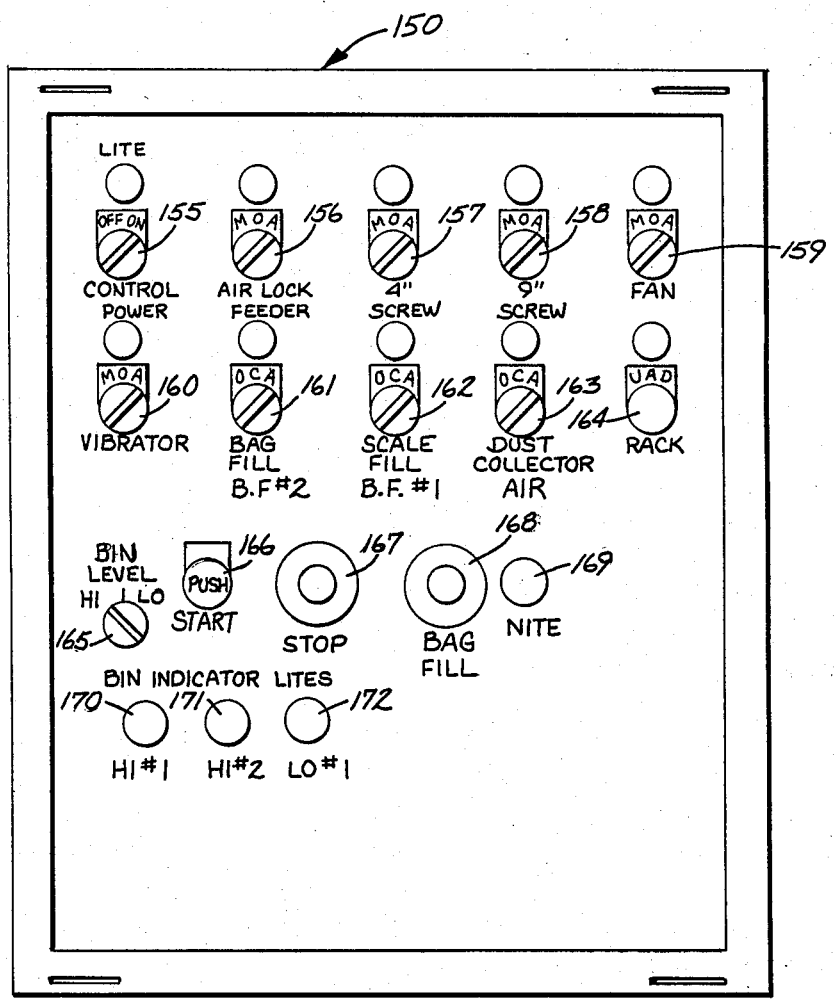
FIG. 8 is a front elevational view of a control panel of the embodiment shown in FIG. 1.
Figure 9A:
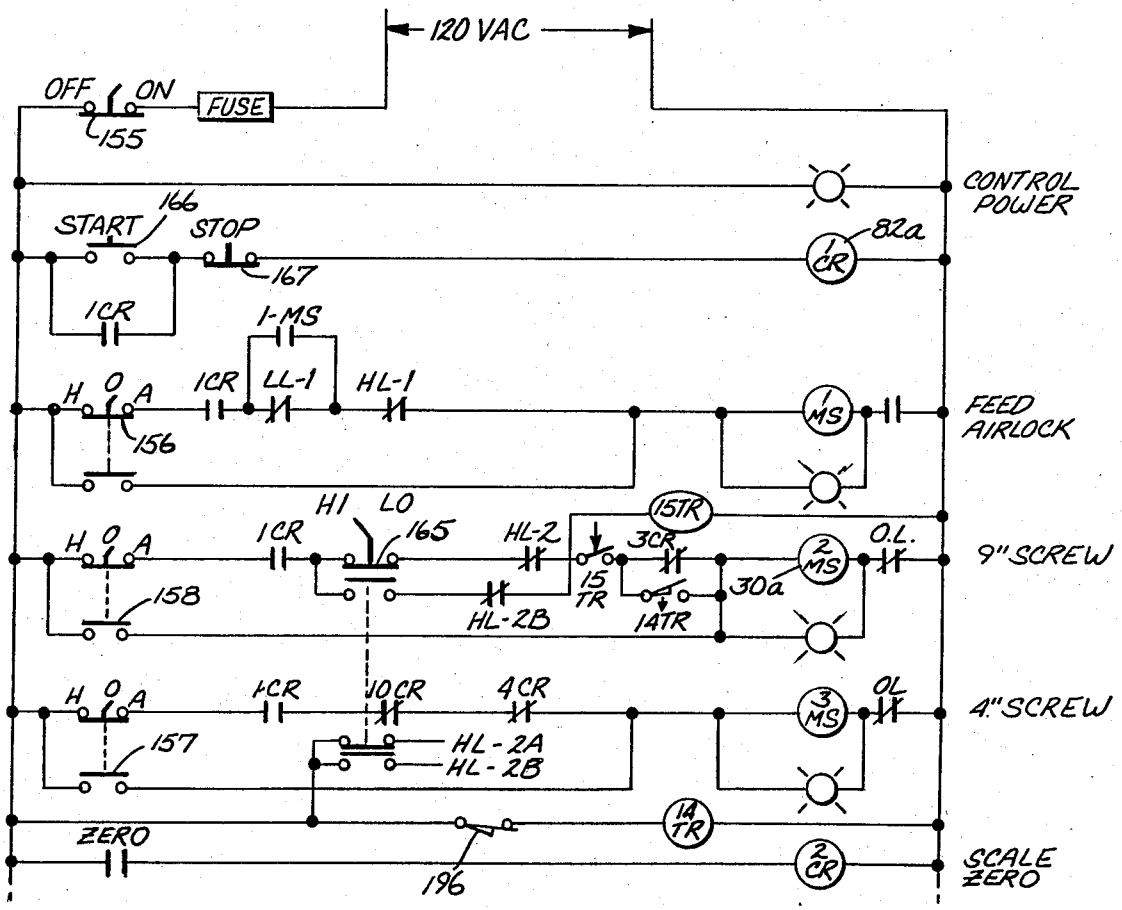
FIG. 9A–D is a schematic of the electrical wiring for the embodiment shown in FIG. 1.
Figure 9B:
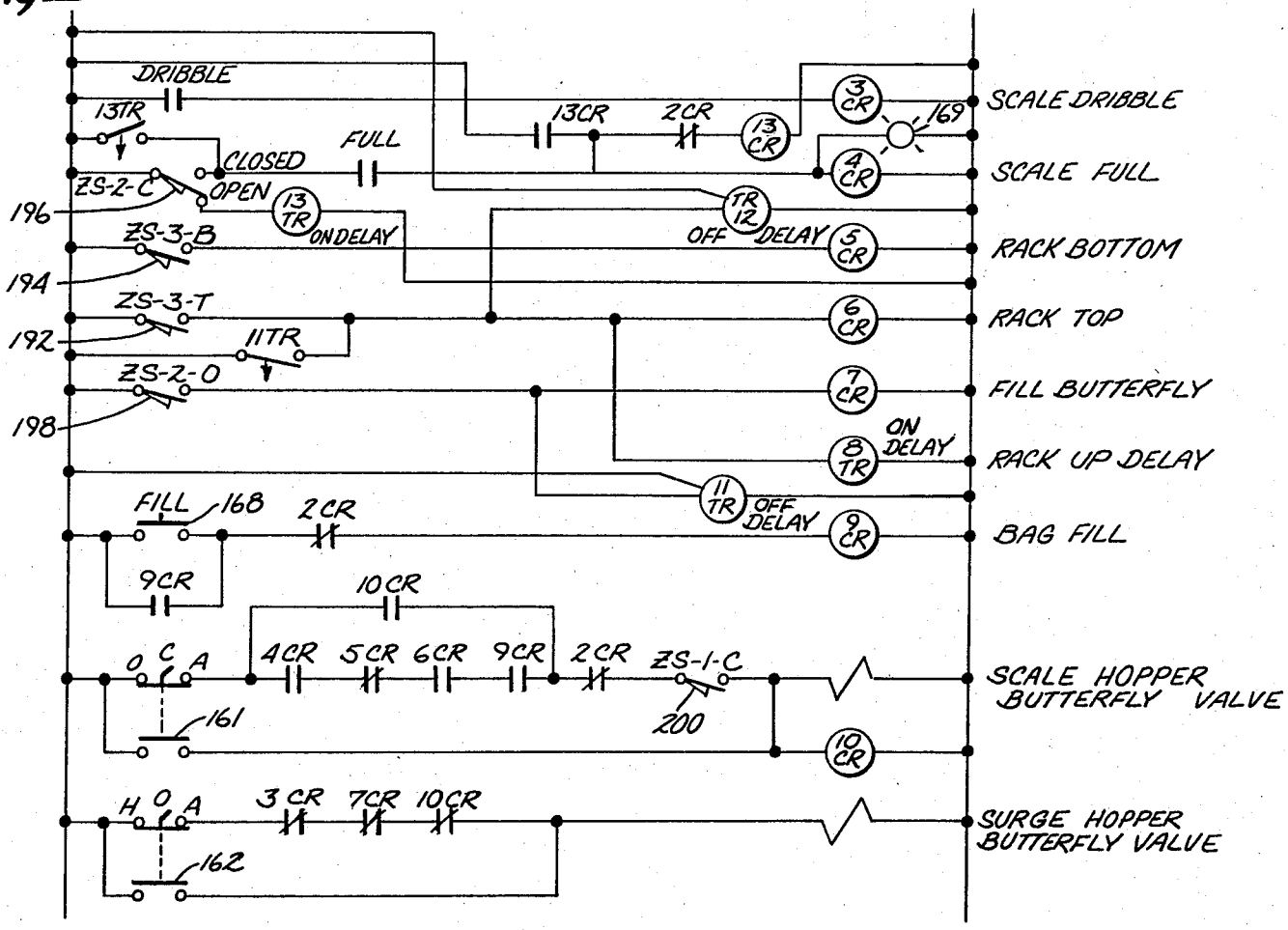
Figure 9C:
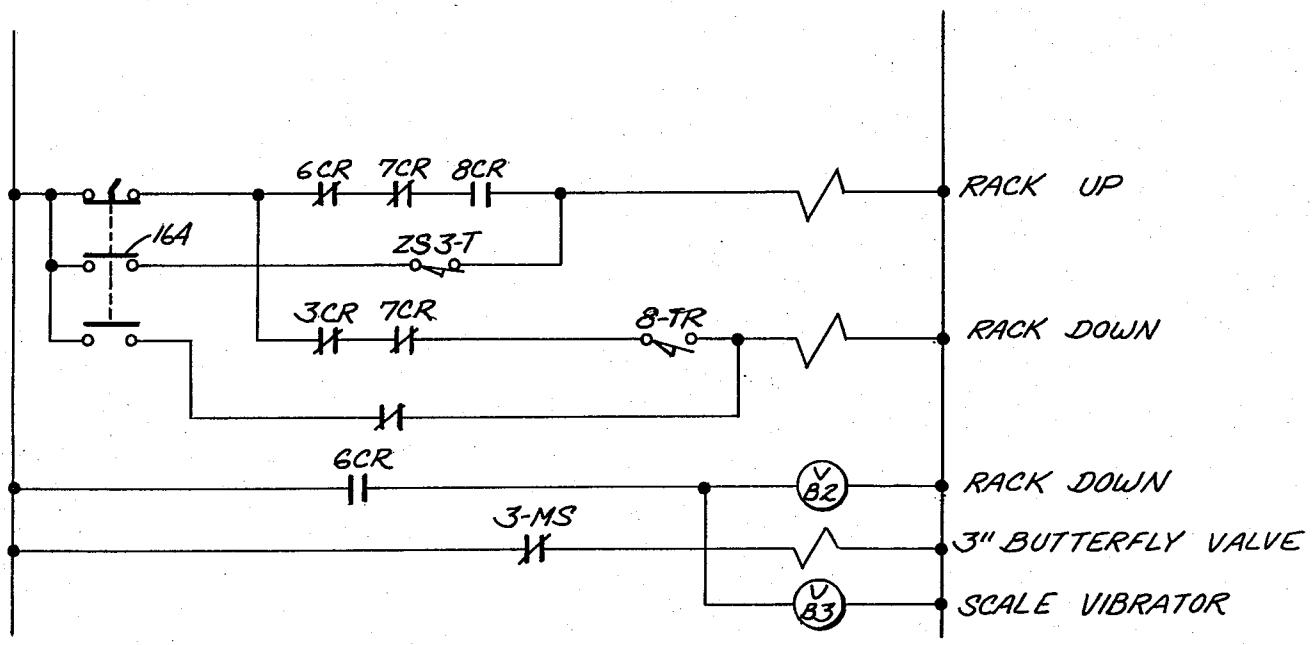
Figure 9D:
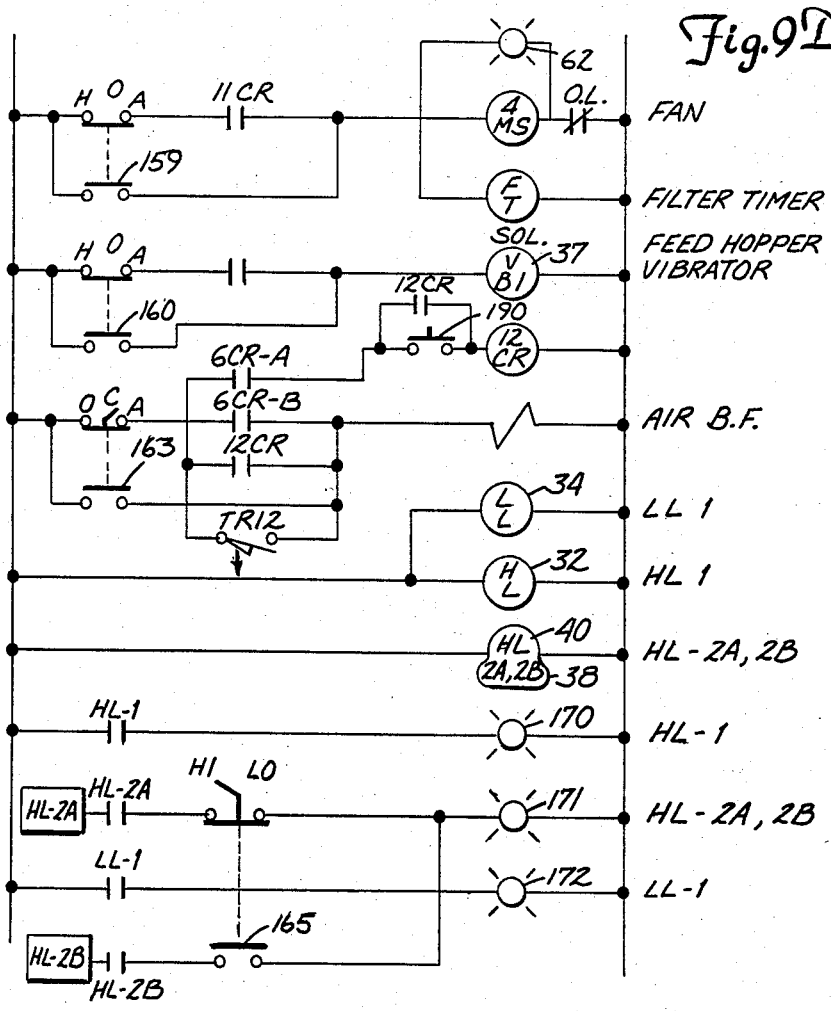

As illustrated in FIG. 8, the control panel 150 includes a control power switch 155 which switches on the power to the system. In addition, the control panel includes three position switches 156–164. The switches 156–160 provide for a manual, off, or automatic setting. The switch 156 controls the air lock 26 of the storage tank 24. The switch 157 controls the four inch metering auger 82 while the switch 158 controls the nine inch feed auger 30. The switch 159 controls the fan 118. The switch 160 controls the vibrator 36 in the feed hopper 22. The switches 161 and 162 control the butterfly valves 86 and 66 of the scale hopper 60 and the surge hopper 28 respectively. The switch 163 controls the butterfly valve 122 in the vent hose 114. The switch 164 is a three position switch providing an up, auto, or down setting for controlling the position of the carriage assembly 130. The two position switch 165 enables selection of the high level sensor 38 or the high level sensor 40 in the surge hopper 28. The start button 166 initiates the overall bag filler apparatus operation. A stop switch 167 terminates the bag filler apparatus operation. A bag fill switch 168 initiates the actual bag fill process for each individual bag. A green indicator light 169 indicates when the bag filler apparatus is in a condition to fill the next bag such that the operator can press the bag fill button 168. Indicators 170–172 indicate when the level detectors 32, 34, 38, and/or 40 have detected a high or low level status in the feeder hopper 22 or the surge hopper 28. The indicator 170 corresponds to the high level detector 32 in the feed hopper 22 while the indicator 172 corresponds to the low level detector 34 in the feed hopper 22. The indicator 171 corresponds to either the high level 38 or the high level detector 40 in the surge hopper 28 depending on the setting of the switch 165. As illustrated in FIG. 8, each of the switches 155–164 might have a corresponding indicator indicating operation of their respective devices. The control panel is preferably a panel designed according to the National Electrical Manufacturer's Association (NEMA) specifications and which meets O.S.H.A. standards. The switches will normally be set in the automatic position for automatic operation of the system.

Figure 10:
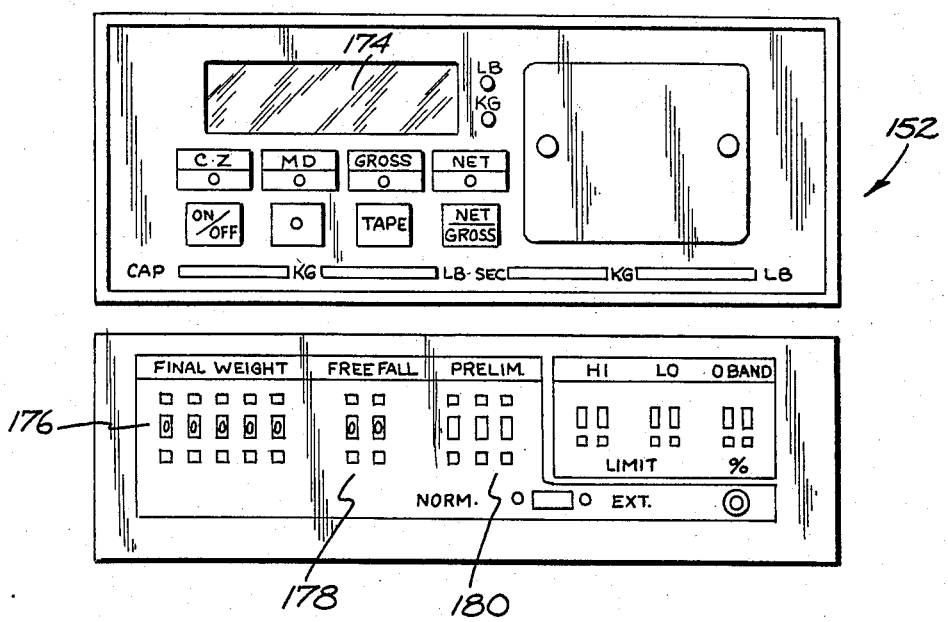
FIG. 10 is as front elevational view of a scale panel of the embodiment shown in FIG. 1.

The scale panel 152 is illustrated in FIG. 10. The embodiment shown is a commercially available weighing indicator and set point unit sold by A & D Engineering, Inc., in San Jose, Calif. The unit is sold under the equipment identifier AD-4316. The unit includes a readout 174 of the weight of the product in the scale hopper 60 as indicated by the load cells 76. In addition, the unit includes a set point unit which includes a digital switch 176 for setting the desired weight of the product to be bagged in each bag. In addition, a switch 178 enables a free-fall weight value to be set and a switch 180 which enables a preliminary weight to be selected. By setting the final weight and the free-fall weight, the preliminary weight is automatically derived by the unit. The free-fall weight corresponds to the weight which is to be delivered by the metering auger 82 after the feed auger 30 has shut down.

Prior to initiating system operation by pressing the start button 166, the user will enter the final weight of the product to be bagged and the free-fall weight at the scale panel 152. For example, if fifty pound bags are to be bagged, the user would enter fifty pounds as the final weight and might enter seven pounds as the free-fall or dribble weight, whereby forty-three pounds would become the preliminary weight. The user need not enter the preliminary weight as the scale panel 152 will calculate this weight from the final weight and the free-fall weight. Further, the user would select and adjust the level detectors 38 and/or 40 to the appropriate setting on the surge hopper 28.

To commence operation after having powered the system on by use of the switch 155, the operator presses the start button 166 at the control panel 150. Pressing the start button 166 causes the air feeder lock 26 to open if the low level detector 34 indicates that there is insufficient product in the feed hopper 22. The surge hopper butterfly valve 66 is opened and the scale hopper butterfly valve 86 is closed. The fan 118 is started and the butterfly valve 122 in the vent hose line 114 is closed so that there is no suction at the fill chute adaptor 104. The nine inch feed auger 30 and the four inch metering auger 82 begin conveying the powdered product to the surge hopper 28 and the scale hopper 60 respectively. The butterfly valve 81 in the chute 84 is open to allow product to be delivered into the scale hopper 60 by the metering auger 82. In the preferred embodiment, the vibrator 36 is operative while the feed auger 30 is operating. At this point both of the augers 30, 82 are feeding the scale hopper 60 as the surge hopper butterfly valve 66 is opened.

When the preliminary weight is reached in the scale hopper 60 as determined by the scale panel 152, the feed auger will be shut down and the butterfly valve 66 closed so no more product is delivered to the scale hopper 60 from the surge hopper 28. When the butterfly valve 66 is closed it will trip a microswitch 200 enabling the butterfly valve 86 to be opened. This normally open switch otherwise prohibits the butterfly valve 86 from being opened when the butterfly valve 66 is opened. After a time delay of roughly zero to ten seconds, preferably two to four seconds the feed auger 30 will be activated to fill the surge hopper 28 to the required level as indicated by the detector 38 or 40. Upon indication by the detector 38 or 40 that sufficient product has been delivered to the surge hopper, the feed auger 30 will be shut down. Preferably, the detector 38 or 40 a will be set to detect roughly the preliminary weight. In meantime, the four inch metering auger 82 continues delivering powdered product to the scale hopper 60. When the weight of the powdered product in the scale hopper 60 reaches the final weight selected at the scale panel 152, the metering auger 82 is shut down and the butterfly valve 81 in the chute 84 is closed. The green indicator light 169 then comes on at the control panel 152 indicating that the system is ready to fill another bag. At this point, the scale panel is electrically isolated from the overall the overall operation until the scale hopper 60 is emptied and the weight goes back to zero. This prevents the butterfly valve 66 from being accidentally opened.

If for some reason too much product drops from the surge hopper 28 into the scale hopper 60, such as might occur when the wrong detector 38 or 40 is activated, an indicator light might come on at the scale panel 152 indicating that to much of the product is in the scale hopper 60. The operator must then manually open the scale hopper 60 and bag the excess product.

Once the green indicator light 169 is on, the operator positions an empty bag over the fill chute adaptor 104 and steps on a foot pedal 190 which opens the butterfly valve 122 in the vent hose line 114 so as to create the suction force at the fill chute adaptor 104. Due to the negative pressure or partial vacuum created by the fan 118 at the fill chute adaptor 104 upon opening of the butterfly valve 122, air rushes through the apertures in the fill chute adaptor 104 and through its open bottom portion as generally illustrated by the arrows 107 and 109 and into the air space 106 between the fill chute 98 and the fill chute adaptor 104 so as to create the suction which draws the top sides of the bag in against the fill chute adaptor 104 and retains the bag in position on the fill chute adaptor 104. Typically the bags will include a plastic liner which is forced tightly against the fill chute adaptor 104 by the resulting suction force. Accordingly, particulate and dust is not allowed to escape from the bag during the fill process. Once the bag is retained in position by the suction force, the operator presses the bag fill button 168 whereby the carriage assembly 130 raises the platform 132 so as to provide support for the bag as it is filled with the powdered product. The butterfly valve 86 is prohibited from opening until the platform 132 reaches a certain height tripping a microswitch 192 which enables the butterfly valve 86 to be opened. When opened, the butterfly valve 86 trips a microswitch 198 which prohibits the surge hopper butterfly valve 86 from being opened. In addition, the scale hopper vibrator 140 is activated and the carriage vibrator 136 is activated to cause any powdered product clinging to the sides of the scale hopper 60 and the bag to drop into the bag. When the scale hopper 60 reaches the zero weight or is emptied as detected by the scale panel 152, the butterfly valve 82 closes and the carriage assembly 130 is lowered. When closed, the butterfly valve 86 trips a microswitch 196 which causes a built in delay prior to filling the next bag even though the scale hopper 60 might be full. When the carriage assembly 130 releases the microswitch 192, a timer is activated such that the butterfly valve 122 in the vent hose line 114 is kept open for a predetermined period of time before being closed. This is an adjustable period of time which is set such that the butterfly valve 122 is closed as the top of the bag begins moving away from the adaptor 104. This assures that no room air with any bacteria or the like will be sucked into the dust filter assembly 116. An additional microswitch might be utilized such that should for some reason the butterfly valve 86 not be closed, when the platform 130 reaches a predetermined height, the microswitch would be tripped causing the butterfly valve 86 to close if not already closed. When the carriage 130 reaches a bottom position it trips another microswitch 194 which shuts off the vibrators 136 and 140. The operator then removes the bag for tying and readies another bag to be filled. Once the butterfly valve 86 is closed, the butterfly valve 66 is opened, the metering auger 82 is started and the butterfly valve 81 is opened to refill the scale hopper 60.

In some applications, the entire bag filling process may take approximately five to six seconds for a fifty pound bag although it will be appreciated that this rate can be increased by varying the rates of the feed auger 30 and the metering auger 82. Correspondingly, the built in time delays could be shortened. Furthermore, it will be appreciated that the total time interval will be affected by the amount of product and the density of the product placed in each of the bags. For example, all else staying the same, if one hundred pound bags were used, the time interval will most likely be increased. It will be appreciated, that while an electrical schematic for one embodiment is illustrated in FIGS. 9A–D, alternate embodiments in keeping with the principles of the present invention might be utilized.

The present invention provides a bag filler apparatus 20 which is totally self contained and occupies very little space, one embodiment of the present invention having a footprint of approximately six and one-half square feet. Furthermore, the present invention is relatively easy to use and provides several safety features. More importantly, the present invention provides the necessary cleanliness and yield required by the food industry of a bag filler apparatus for powdered or granular product.

It is to be understood, however, that even though these numerous characteristics and advantages of the invention have been set forth in the foregoing description, together with details of the structure and the function of the invention, the disclosure is illustrative only, and changes may be made in detail, especially in matters of shape, size and arrangement of parts, within the principle of the invention, to the full extent indicated by the broad general meaning of the terms of which the appended claims are expressed.

What is claimed is:

1. A bag filler apparatus for filing bags with a powdered product, the bags having side walls interconnecting an open top portion and a closed bottom portion, the apparatus comprising:

(a) a support framework;

(b) surge hopper means for holding a first quantity of the powdered product;

(c) first feeder conveyor means for conveying the powdered product to the surge hopper means;

(d) scale hopper means for holding a second quantity of the powdered product;

(e) interconnection means interconnecting the surge hopper means to the scale hopper means for providing a path for the flow of the powdered product from the surge hopper means to the scale hopper means;

(f) first valve means cooperating with said interconnection means for controlling the flow of the powdered product into the scale hopper means from the surge hopper means;

(g) fill chute means interconnected proximate the bottom of the scale hopper means for providing a path for the flow of the powdered product from the scale hopper means;

(h) second valve means cooperating with the fill chute means for controlling the flow of the powdered product from the scale hopper means;

(i) fill chute adaptor means adapted for insertion into the open top portion of a bag, said fill chute adaptor means cooperating with the fill chute means so as to define an air space between the fill chute means and the fill chute adaptor means, the fill chute adaptor means having side walls with a plurality of apertures therein and being at least partially open at a lower end thereof;

(j) vacuum means interconnected to the fill chute adaptor means for creating a partial vacuum condition in the air space between the fill chute means and the fill chute adaptor means whereby the side walls of the bag proximate the open top portion thereof are drawn inwardly against the fill chute adaptor means and particulate suspended inside the bag is removed therefrom;

(k) control means for controlling the operation of the first and second valve means and the vacuum means, said control means including weight sensing means for sensing the weight of the powdered product in the scale hopper means, said control means including means for terminating said partial vacuum condition when the bag is removed from the fill chute adaptor means, whereby room air outside of the bag is not drawn into the vacuum means when the bag is removed; and (l) second metering conveyor means for conveying the powdered product to the scale hopper means, the second metering conveyor means conveying the powdered product at a lesser rate than the first feeder conveyor means.

2. An apparatus in accordance with claim 1, wherein the interconnection means interconnecting the surge hopper means and the scale hopper means is a flexible connection enabling pivotal mounting of said scale hopper means about its longitudinal axis, the scale hopper means being supported independently of the surge hopper means by the support framework.

3. An apparatus in accordance with claim 2, wherein the scale hopper means is suspended from the support framework by three weight sensitive elements positioned circumferentially about the scale hopper means.

4. An apparatus in accordance with claim 3, wherein each of the weight sensitive elements includes a load cell element pivotally interconnected at a top and bottom portion thereof to an elongated frame member such that the scale hopper means is pivotally suspended from the support framework by the three load cells.

5. An apparatus in accordance with claim 1, wherein the fill chute adaptor means is interconnected to the scale hopper means by a flexible connection, the fill chute adaptor means being separately supported by the support framework independent of the scale hopper means.

6. A bag filler apparatus for filling bags with a powdered product, the bags having side walls interconnecting an open top portion and a closed bottom portion, the apparatus comprising:

(a) a support framework;

(b) surge hopper means for holding a first quantity of the powdered product;

(c) first feeder auger means for conveying the powdered product from a source of the powdered product to the surge hopper means;

(d) scale hopper means for holding a second quantity of the powdered product;

(e) interconnection means interconnecting the surge hopper means to the scale hopper means for providing a path for the flow of the powdered product from the surge hopper means to the scale hopper means;

(f) first valve means cooperating with said interconnection means for controlling the flow of the powdered product into the scale hopper means from the surge hopper means;

(g) second metering auger means for conveying the powdered product from the source of the powdered product to the scale hopper means at a lesser rate than the first feeder auger means so as to enable accurate metering thereof;

(h) fill chute means interconnected proximate the bottom of the scale hopper means for providing a path for the flow of the powdered product from the scale hopper means;

(i) second valve means cooperating with the fill chute means for controlling the flow of the powdered product from the scale hopper means;

(j) fill chute adaptor means adapted for insertion into an open top portion of a bag, said fill chute adaptor means cooperating with the fill chute means so as to define an air space between the fill chute means and the fill chute adaptor means, the fill chute adaptor means having side walls with a plurality of apertures therein and being at least partially open at a lower end thereof;

(k) vacuum means interconnected to the fill chute adaptor means for creating a partial vacuum condition in the air space between the fill chute means and the fill chute adaptor means whereby the side walls of the bag proximate the open top portion thereof are drawn inwardly against the fill chute adaptor means and particulate suspended inside the bag is removed therefrom;

(l) first vent means interconnected to the surge hopper means for venting the surge hopper means;

(m) second vent means interconnected to the scale hopper means for venting the scale hopper means; and (n) control means for controlling the operation of the first and second valve means and the vacuum means, said control means including weight sensing means for sensing the weight of the powdered product in the scale hopper means, said control means including means for terminating said partial vacuum condition when the bag is removed from the fill chute adaptor means, whereby room air outside of the bag is not drawn into the vacuum means when the bag is removed.

7. A bag filler apparatus in accordance with claim 6, wherein the first feeder auger means includes at least four flights and the second metering auger means is at least double flighted, the first feeder auger means being of larger diameter than the second metering auger means.

8. A bag filler apparatus for filling bags with a powdered product, the bags having sidewalls interconnecting an open top portion and a closed bottom portion, the apparatus comprising:

(a) a support framework;

(b) surge hopper means for holding a first quantity of the powdered product;

(c) first feeder conveyor means for conveying the powdered product from a source of the powdered product to the surge hopper means;

(d) scale hopper means for holding a second quantity of the powdered product, the scale hopper means being interconnected to the surge hopper means by interconnection means providing a passageway for the flow of the powdered product from the surge hopper means to the scale hopper means, first valve means being operatively interconnected to the passageway for opening and closing the passageway, the scale hopper means being separately supported by the support framework independently of the surge hopper;

(e) second metering conveyor means for conveying the powdered product from the source of the powdered product to the scale hopper means;

(f) weight sensing means interconnected to the scale hopper means for sensing the weight of the powdered product in the scale hopper means, said weight sensing means being operatively interconnected to the first valve means to close the first valve means upon detection of a first predetermined weight, said weight sensing means being operatively interconnected to the second conveyor means to stop conveying of the powdered product by the second metering conveyor means upon dectection of a second metering predetermined weight of the powdered product in the scale hopper means;

(g) discharge means for selectively discharging the powdered product from the scale hopper means into a bag, said discharge means adapted for partial insertion into the open top portion of the bag;

(h) vacuum means operatively interconnected to the discharge means for creating a suction force at the discharge means for removing particulate suspended in the inside of the bag; and (i) control means operatively interconnected to the vacuum means for terminating the suction force when the bag is removed from the discharge means whereby the ambient room air on the outside of the bag is not drawn in by the vacuum means.

* * * * *

UNITED STATES PATENT AND TRADEMARK OFFICE

CERTIFICATE OF CORRECTION

PATENT NO. : 4,614,213

DATED : September 30, 1986

INVENTOR(S) : Robert A. Englin

It is certified that error appears in the above-identified patent and that said Letters Patent is hereby corrected as shown below:

Col. 1, line 64, delete "any" and insert --many--.

Col. 9, line 36, delete "a".

Col. 9, line 47, delete "the overall".

Col. 9, line 55, delete "to" and insert --too--.

Col. 14, line 25, after "second" insert --metering--.

Col. 14, line 28, delete "metering".

ON THE TITLE PAGE; the title of this Patent should be: DUSTLESS BAG FILLER APPARATUS.

Signed and Sealed this

Seventeenth Day of February, 1987

*Attest:*

DONALD J. QUIGG

*Attesting Officer*

*Commissioner of Patents and Trademarks*